US005336041A

United States Patent [19]

Seidel et al.

[11] Patent Number: 5,336,041

[45] Date of Patent: Aug. 9, 1994

[54] STORAGE AND RETRIEVAL DEVICE AND METHOD FOR IMBRICATED PLANAR ARTICLES

[75] Inventors: Randy R. Seidel, Allentown; Anthony Kononov, Sumneytown; Roger Honegger, Andalusia, all of Pa.; Robert M. Silva, Milford, N.J.

[73] Assignee: Graphic Management Associates, Inc., Southborough, Mass.

[21] Appl. No.: 980,768

[22] Filed: Nov. 24, 1992

Related U.S. Application Data

[63] Continuation-in-part of Ser. No. 850,414, Mar. 12, 1992, abandoned.

[51] Int. Cl.[5] ..... B65G 57/00; B65G 59/00; B65H 29/00

[52] U.S. Cl. ..... 414/788; 414/933; 414/927; 414/928; 414/929; 414/789.5; 414/791.6; 414/794.2; 414/794.4; 414/797.2; 271/151

[58] Field of Search ..... 271/149, 151, 216; 414/788, 933, 929, 928, 927, 789.5, 791.6, 794.2, 794.4, 797.2

[56] References Cited

U.S. PATENT DOCUMENTS

| | | | |
|---|---|---|---|
| 4,274,623 | 6/1981 | Reist et al. | 414/792.2 |
| 4,525,982 | 7/1985 | Meier | 414/788 |
| 4,927,318 | 5/1990 | Hayden et al. | 414/791.6 |
| 5,022,644 | 6/1991 | Burge | 271/216 |
| 5,135,351 | 8/1992 | Rathert | 414/789.5 |

*Primary Examiner*—H. Grant Skaggs
*Attorney, Agent, or Firm*—Jordan B. Bierman

[57] ABSTRACT

A device for stacking and destacking a stream of imbricated, substantially planar, flexible units to form or destack a layered stack. The device is a stacker, adapted to receive a stream of units from a source thereof, and a plurality of transfer sheets. The feeder delivers the stream of units to the stacker.

The stacker has staging belts which receive portions of the stream and deposit the units serially on one of the transfer sheets, as it is withdrawn from the sheet stack. This forms an imbricated layer of the units and the transfer sheet. The stacker deposits the imbricated layer on a removable support and repeats the cycle to deposit successive imbricated layers on the preceding layers. Destacking is carried out by simply reversing the process.

34 Claims, 10 Drawing Sheets

FIG. 7
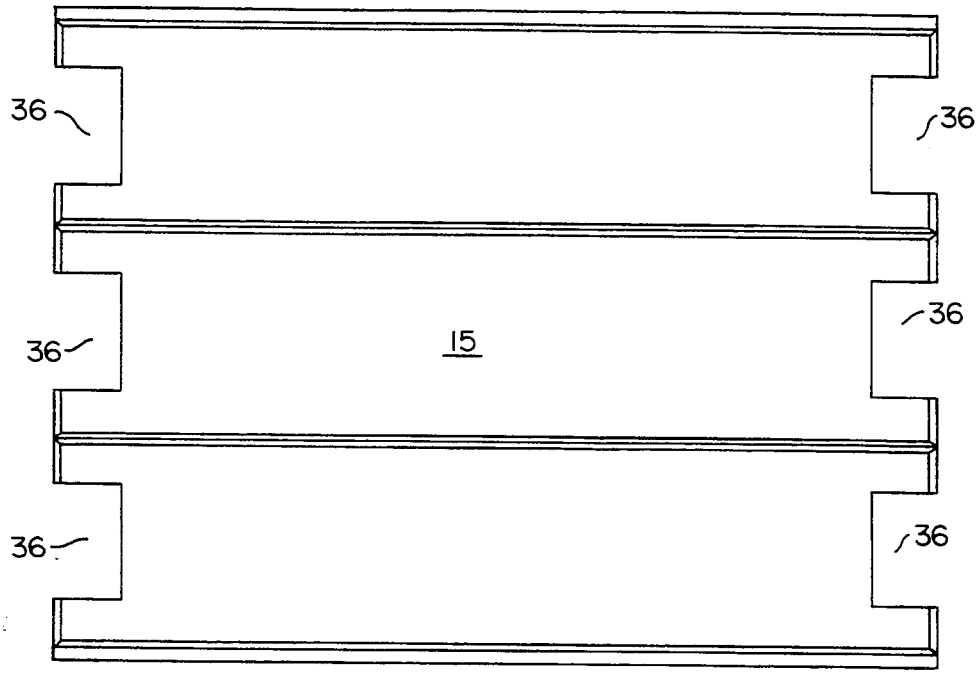
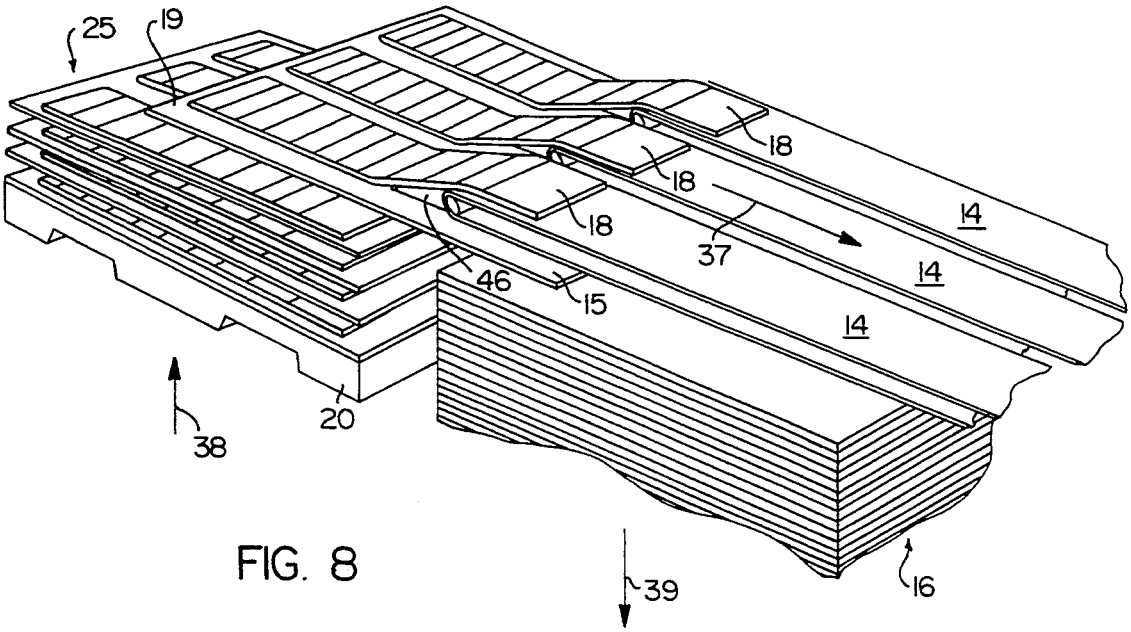
FIG. 8

STORAGE AND RETRIEVAL DEVICE AND METHOD FOR IMBRICATED PLANAR ARTICLES

This application is a continuation-in-part of U.S. application Ser. No. 07/850,414, filed Mar. 12, 1992, now abandoned.

The present invention is directed to a device and method for storage and retrieval of flat, planar, usually flexible articles. The invention will be discussed and described in connection with the handling of printed material, such as newspapers, but this is by way of convenience only and is not intended to limit the application of the invention.

BACKGROUND OF THE INVENTION

Newspapers, both daily and particularly Sunday editions, are made up of an outer section or jacket and one or more inserts of various kinds. These inserts consist of additional sections, advertising brochures, leaflets, and the like. Since the jacket usually contains the latest news, it is, of necessity, printed last. The inserts, not being so time sensitive, are prepared in advance and stored until needed.

Therefore, it is desirable to be able to take the various inserts from their sources (usually printing presses), store them for a period of time until the jackets are ready, retrieve them, and insert them into the jackets. Furthermore, it is particularly advantageous if the inserts can be maintained in imbricated form during all of the foregoing operations. Thus, there is a need for a device which will take the inserts from the presses, imbricate them, store and retrieve them in imbricated form, and deliver them to the next processing device, usually an inserter. Moreover, the system should be mobile so that the inserter can be in one building and the inserts stored in another. The present invention is intended to provide such a device.

BRIEF DESCRIPTION OF THE INVENTION

The present invention is directed to a device and method for forming a stack made up of layers of imbricated, substantially planar, flexible units. The device and method are also capable of retrieving (destacking) the imbricated layers from the completed stack.

In essence, the invention comprises a source of a continuous stream of the aforementioned units, a storage and retrieval unit, which receives the stream and, as transfer sheets are withdrawn from a stack thereof, deposits the copies thereon as an imbricated layer. The layer is placed on a support and successive layers, as formed, are deposited in a similar manner on the preceding layers.

Advantageously, a pallet of standard width is provided as the support. Thus, when the stack is complete, it can be removed from the device by means of a pallet jack and/or a fork lift truck. If rollers are provided beneath the pallet, it can be easily rolled out of the device manually, if desired.

In a particularly desirable modification of the device, the functions of the stager and pallet storage are combined in one section. The advantage of this embodiment resides in the reduced amount of floor space which is required by the device.

BRIEF DESCRIPTION OF THE DRAWINGS

In the accompanying drawings, constituting a part hereof, and in which like reference characters indicate like parts.

FIG. 7 is a plan view of a transfer sheet;

FIG. 8 is a view similar to that of FIG. 4 showing retrieval of the copies from the stack;

DETAILED DESCRIPTION OF THE INVENTION

Figure 1:
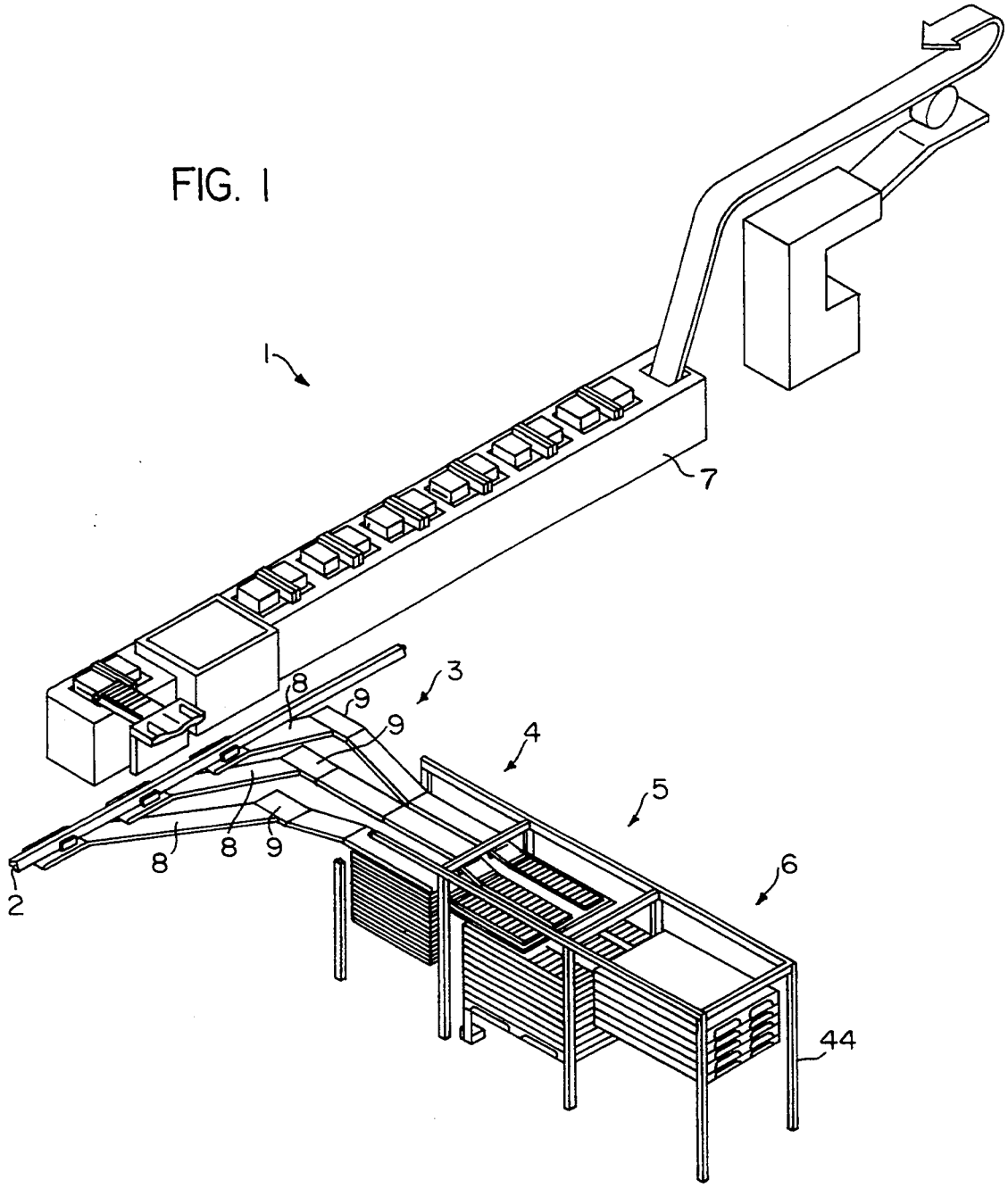
FIG. 1 is a perspective schematic view of the storage and retrieval device, with some parts omitted for clarity.

Referring more specifically to FIG. 1, storage and retrieval device 1 comprises gripper conveyor 2, shingle diverter 3, transfer sheet storage and stager 4, stack formation section 5, and pallet storage 6. The next handling step is illustrated as inserter 7, but this device forms no part of the present invention. It can be replaced by any desired handling step or device.

Figure 2:
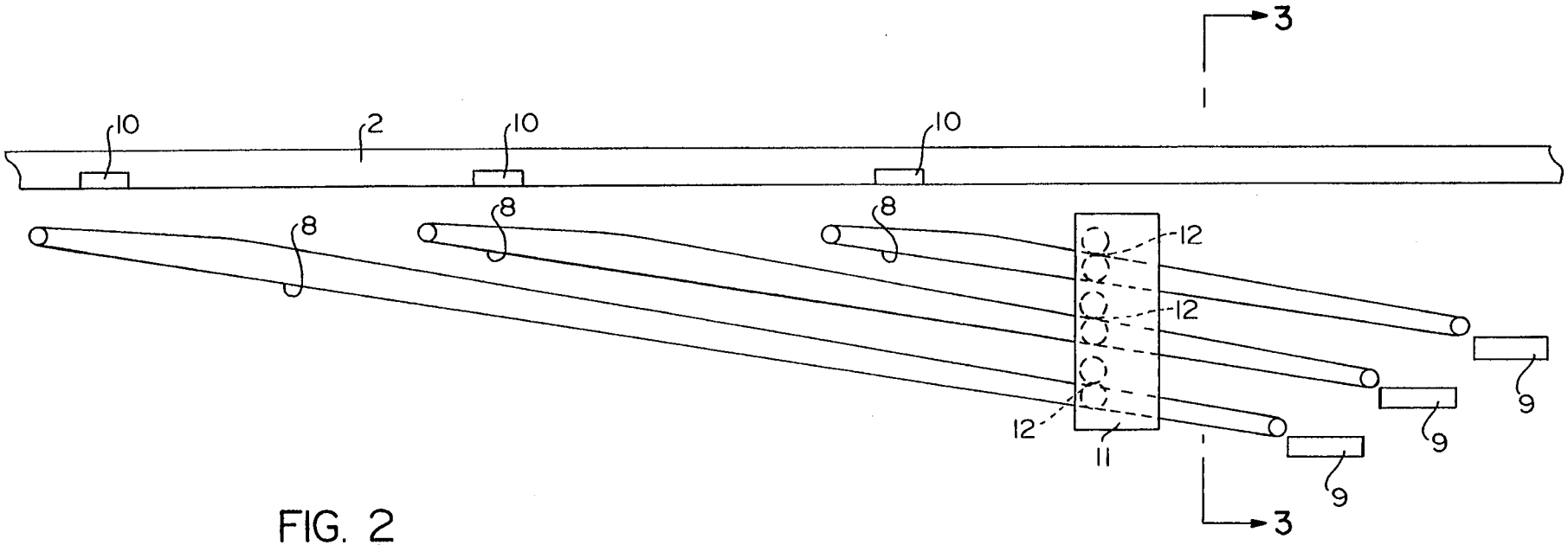
FIG. 2 is a schematic view of the releases, lay down belt, fold pressers, and diverter belt.
Figure 3:
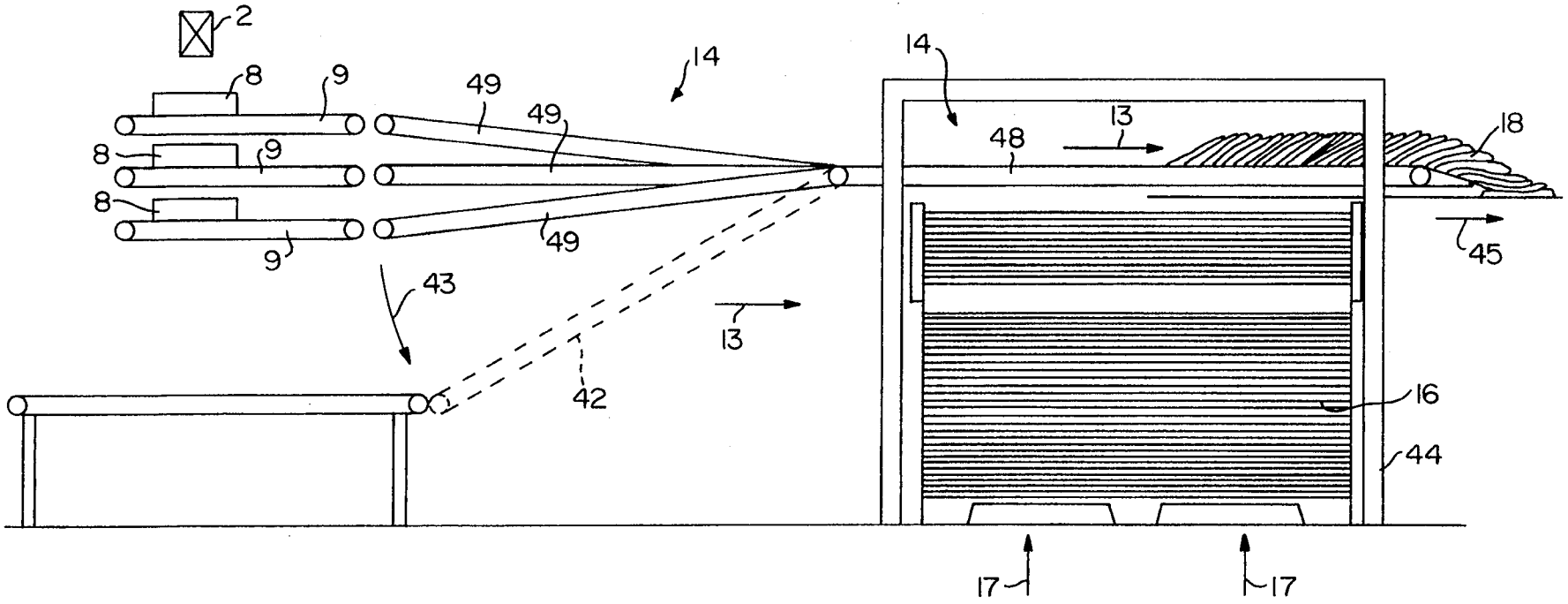
FIG. 3 is a schematic cross-section along the line 3—3 of FIG. 2, also showing the transfer sheet storage and stager.

The feed mechanism is shown more specifically in FIGS. 2 and 3. Gripper conveyor 2 is provided with releases 10, one of which is over each lay down belt 8. Releases 10 open the appropriate grippers (not shown) and deposit the copies onto the respective lay down belts 8. The folded edges of the copies are transverse to the direction of movement of belts 8. Since air is often contained in the copies, it is preferably removed by passing them through fold presser 11, which comprises pairs 12 of rollers, there being one pair for each belt 8.

The present invention is fully operable if the newspaper copies are fed to the shingle diverter and/or stager with their folded edges transverse to the direction of movement of the belts carrying them. However, if this is done, since the folded edges are the longer dimension, the rows of copies will end up being spaced further apart than a standard pallet width. Therefore, it is particularly advantageous for lay down belts 8 to deposit the copies on diverter belts 9, which are at right angles thereto. As a result, the copies are thus positioned with their folded edges parallel to the direction of movement of diverter belts 9 and staging belts 14.

A further advantage resides in the fact that lay down belts 8 and diverter belts 9 can be separately controlled so that their respective speeds are independent of each other. By suitable adjustment of the relative speeds, the degree of imbrication of the copies can be controlled.

Thus, if diverter belts 9 are speeded up relative to feed belts 8, the amount of imbrication will decrease. On the other hand, if diverter belts 9 are slowed relative to feed belts 8, the degree of imbrication will be increased and the leading edges of adjacent copies will be located closer to one another. Since it is desired to maintain an approximately equal thickness of the layers (suitably about 2½ inches), thicker copies require less imbrication than thinner copies. The foregoing mechanism provides a means for making any necessary or desirable adjustments with respect thereto.

Copies 18 then proceed in the direction of arrows 13 (see FIG. 3) and are deposited on adjustable portions 49 of staging belts 14 by diverter belts 9. The copies are then carried to horizontal portions 48 of belts 14 which are located in frame 44. Stack 16 of the transfer sheets is beneath staging belts 14. Top sheet 15 is moved in the direction of arrow 45 and, at the same time, staging belts 14 deposit copies 18 thereon, thus forming an imbricated layer. As each transfer sheet 15 is removed from stack 16, stack 16 is moved in the direction of arrows 17 by approximately the thickness of one sheet 15 so as to maintain the top sheet in the same position relative to staging belts 14.

Figure 4:
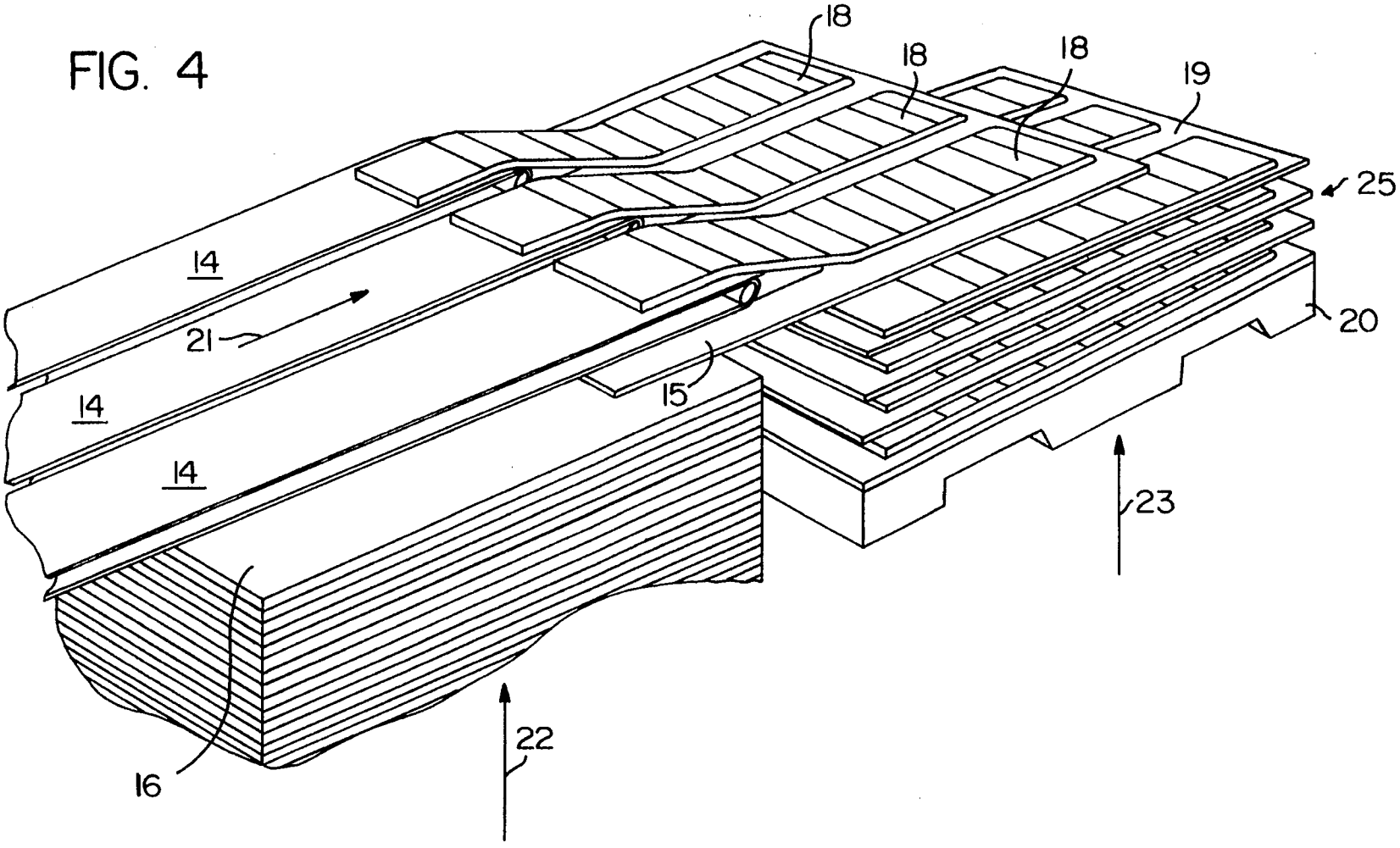
FIG. 4 is a schematic perspective view, with parts omitted for clarity, showing the formation of the imbricated layers and stack.

The staging belts and associated elements of the invention are shown in greater detail in FIG. 4. For formation of the storage stack, belts 14 move in the direction of arrow 21. As transfer sheet 15 is withdrawn from stack 16 (to the right as shown in FIG. 4), belts 14 synchronously feed copies 18 thereon, thus forming layers 19 and placing them on top of one another to form layered stack 25. Pallet 20 is located at the bottom of stack 25 and is moved in the direction of arrow 23 as layers 19 are deposited at the top thereof. The movement of pallet 20 is controlled so that the uppermost layer 19 is always at the proper level to receive sheet 15 and copies 18. Analogously, stack 16 is moved in the direction of arrow 22 as each transfer sheet 15 is removed therefrom, thus keeping the top sheet at the appropriate level.

Since the present invention is intended to be used in conjunction with a continuous stream of copies, provision must be made for continuing to receive copies, even though the storage and retrieval mechanism has paused to permit a completed stack to be removed and a new pallet introduced. Copies 18 are deposited in a predetermined length on one of the three lay down belts 8. When that one is full, it begins transfer to one of diverter belts 9. This is repeated for second and third feed belts 8 and second and third diverter belts 9. In similar manner, diverter belts 9 transfer copies 18 to staging belts 14. Hence, while staging belts 14 are waiting until all three are filled, there is at least one lay down belt 8 and diverter belt 9 which can receive copies 18 from the continuous stream. Thus, there need be no interruption or spaces between the predetermined copy lengths and the device can receive copies 18 from the continuous stream and form them into desired stacks 25.

Figure 5:
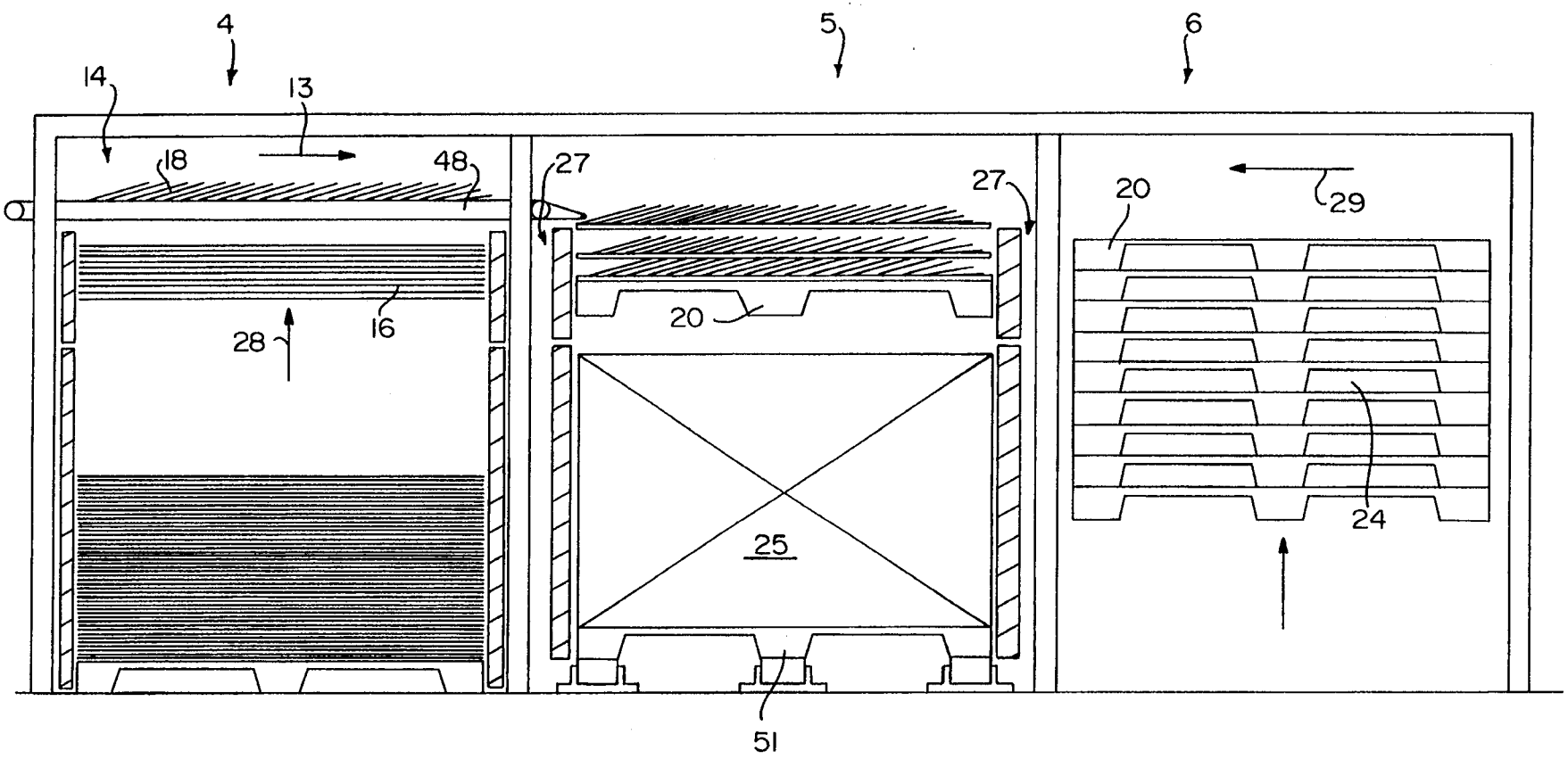
FIG. 5 is a schematic elevation, with parts omitted for clarity, of the staging, stacking, and pallet supply storage.
Figure 6:
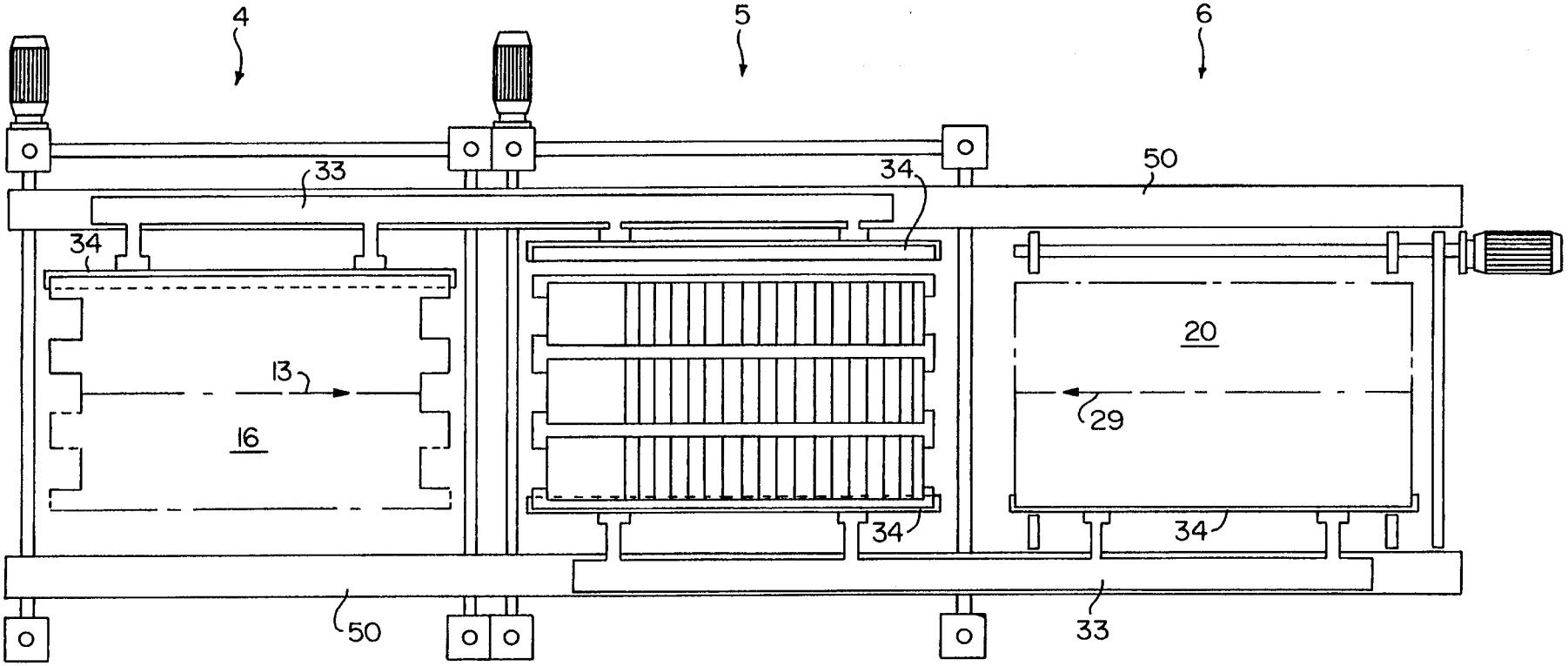
FIG. 6 is a plan view of the device as shown in FIG. 5.

In FIGS. 5 and 6, the operation of stager 4, stack formation section 5, and pallet storage 6 is shown. Guides 50 receive sliders 33 which are adapted for motion to the left and right as shown in FIG. 6. Shovels 34 are mounted on sliders 33 and are movable toward and away from each other in a direction perpendicular to that of sliders 33. Sliders 33 are shown in their extreme left position in the upper portion of FIG. 6 and in their extreme right position in the lower portion of that figure. However, the pairs of sliders 33, and their attached shovels 34, are intended to move in the same direction and at the same time.

When horizontal portions 48 of belts 14 are ready to discharge copies 18 onto the stack being formed in stack formation section 5, both sliders 33 move to the left position, as shown in the upper part of FIG. 6. Shovels 34 then move toward each other so as to slide partially under and hold the top most transfer sheet. This position is shown in the upper portion of FIG. 6 at stager 4. Sliders 33 then move to the right in synchronism with horizontal portion 48 of staging belts 14 (not shown in FIG. 6). This position is shown at the lower half of FIG. 6 at stack formation section 5. The cycle is repeated as needed until the stack is fully formed. Thereafter, the leveler (not shown) lowers stack 25 (see FIG. 5) so that the uppermost layer is beneath the level of shovels 34 and buffer 27. Stack 25 is then removed from the device in a direction transverse to arrows 13 and 29.

At this point, sliders 33 are in their right position as shown in the bottom half of FIG. 6. Shovels 34 move toward each other and grip pallet 20 at the top of pallet stack 24. Sliders 33 then move to their left position, carrying pallet 20 to buffer 27 in stack formation section 5. The transfer sheets, with copies 18 synchronously deposited thereon, are moved by sliders 33 and shovels 34 onto buffer 27. Meanwhile, base 51 rises so that it contacts the underside of bottom pallet 20. Thereafter, buffer 27 releases and the stack formation continues until completed.

When stack 25 is completed and removed from the device, it can be stored at any desired or convenient location. Since the system is quite mobile, the stacks can even be stored in a building apart from the one in which the device of the present invention is located.

When it becomes necessary to retrieve copies 18, stack 25 is returned to area 5. In order to maintain the proper orientation of copies 18, it is necessary to rotate stack 25 180° about its vertical axis. It is then returned to area 5 for retrieval.

Referring now to FIG. 8, the first step of retrieval is shown. Staging belts 14 are reversed and transfer sheet 15 forming part of upper layer 19 is moved in the direction of arrow 37. Noses 46 on one end of diverter belts 14 enter between copies 18 and transfer sheets 15. Copies 18 are carried onto horizontal portions 48 of staging belts 14, and transfer sheet 15 is placed on the top of stack 16. The support for stack 16 then moves in the direction of arrow 39 to prepare stack 16 to receive the next transfer sheet 15. At the same time, the support for pallet 20 moves in the direction of arrow 38. Thus, the transfer takes place at the same level at all times.

In a preferred form of the invention, transfer sheet 15 is provided with notches 36 at one or both ends thereof (see FIG. 7). Notches 36 correspond and are complementary to noses 46. This assists in the separation of copies 18 from transfer sheet 15.

Figure 9:
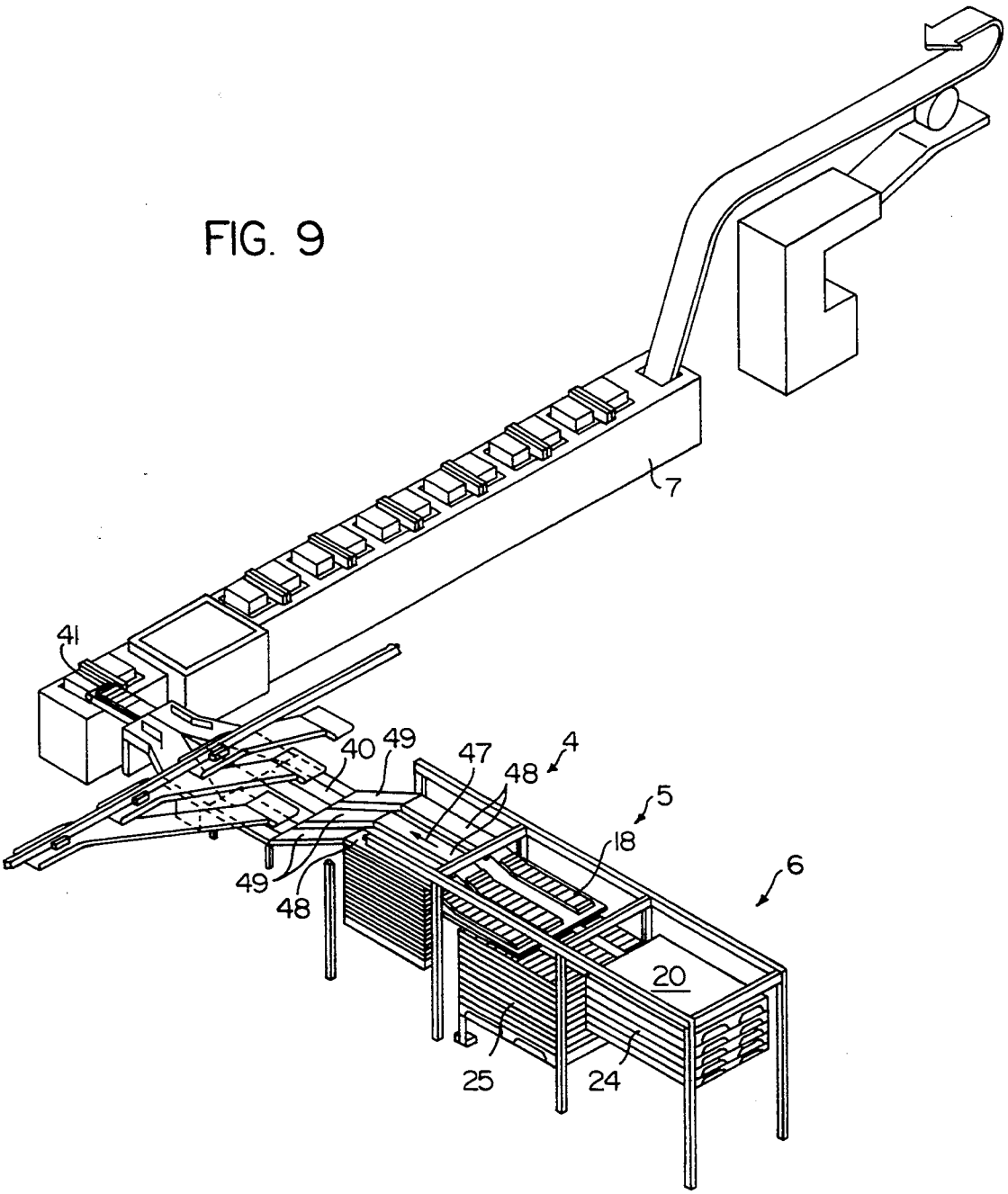
FIG. 9 is a view, similar to that of FIG. 1, showing the copies being retrieved and carried forward to the inserter.

As shown in FIG. 9, staging belts 14 move in the direction of arrow 47 and feed copies 18 onto adjustable portion 49. As can be seen in FIG. 3, adjustable portion 49 move in the direction of arrow 43 to assume retrieval position 42 as shown in phantom. Referring again to FIG. 9, copies 18 are then deposited, one row at a time, onto converter table 40, thereby to form single stream 41 which, in the embodiment shown, passes on to inserter 7.

Figure 10:
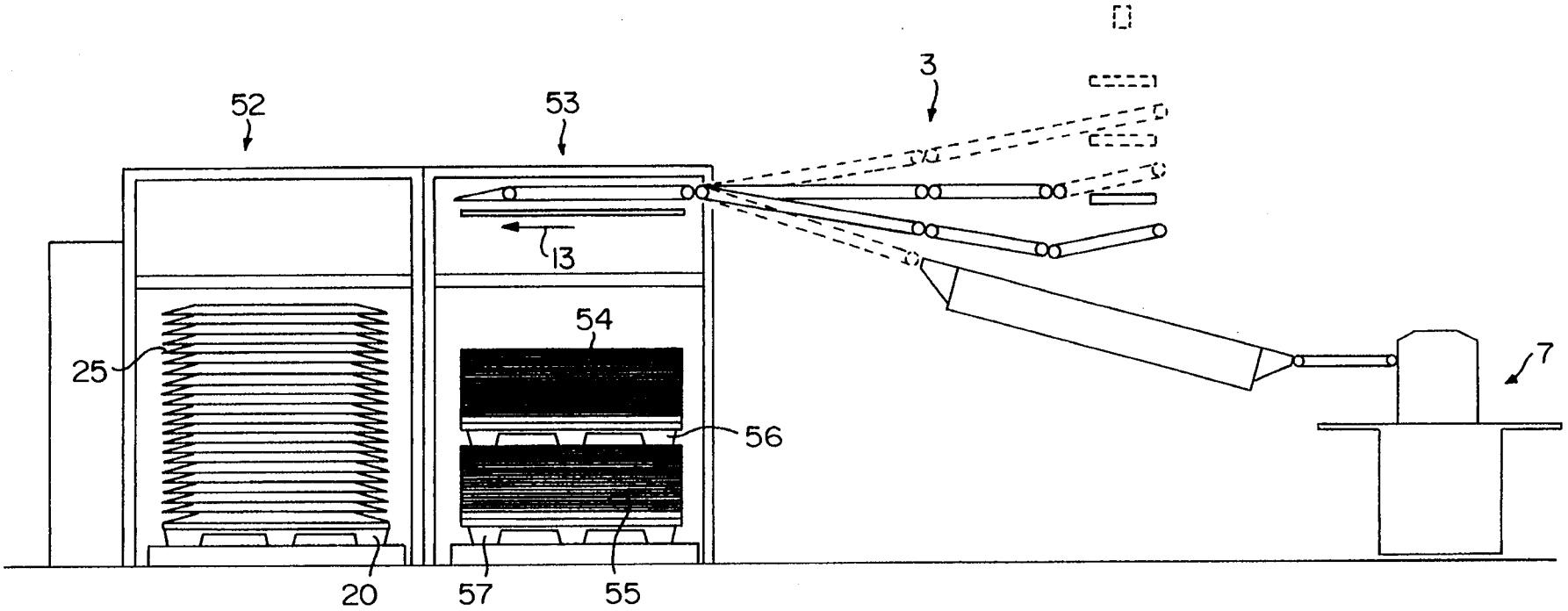
FIG. 10 is a side elevation of a preferred embodiment of the present invention.

A preferred form of the device is shown diagrammatically in FIG. 10. This is a view substantially comparable to that of FIG. 5. Pallet building section 52 contains pallet 20 and stack 25. However, stager 4 and pallet storage 6 are combined into pallet feed section 53. Section 53 contains upper pallet 56 and lower pallet 57, carrying stacks 54 and 55 of a predetermined number of transfer sheets, respectively. Operation is initiated by inserting pallet 20, carrying a transfer sheet is placed in section 52. It is elevated in the same manner as in the principal form of the device. As new transfer sheets are needed, they are taken from stack 54; this process continues until stack 54 has one transfer sheet left and stack 25 is complete.

Stack 25 is then moved out of section 52, preferably in a direction transverse to the direction of flow of the units. At the same time, upper pallet 56, carrying a transfer sheet, is moved from pallet feed section 53 to pallet building section 52 and lower pallet 57, carrying stack 55 of transfer sheets, moves upwardly to an appropriate level so that the uppermost transfer sheet can be taken from stack 55 and fed to pallet building area 52 as stack 25 is built. A new pallet (not shown), also carrying the predetermined number of transfer sheets, is moved into position beneath pallet 55. The cycle is now complete and can be repeated as desired.

Figure 11:
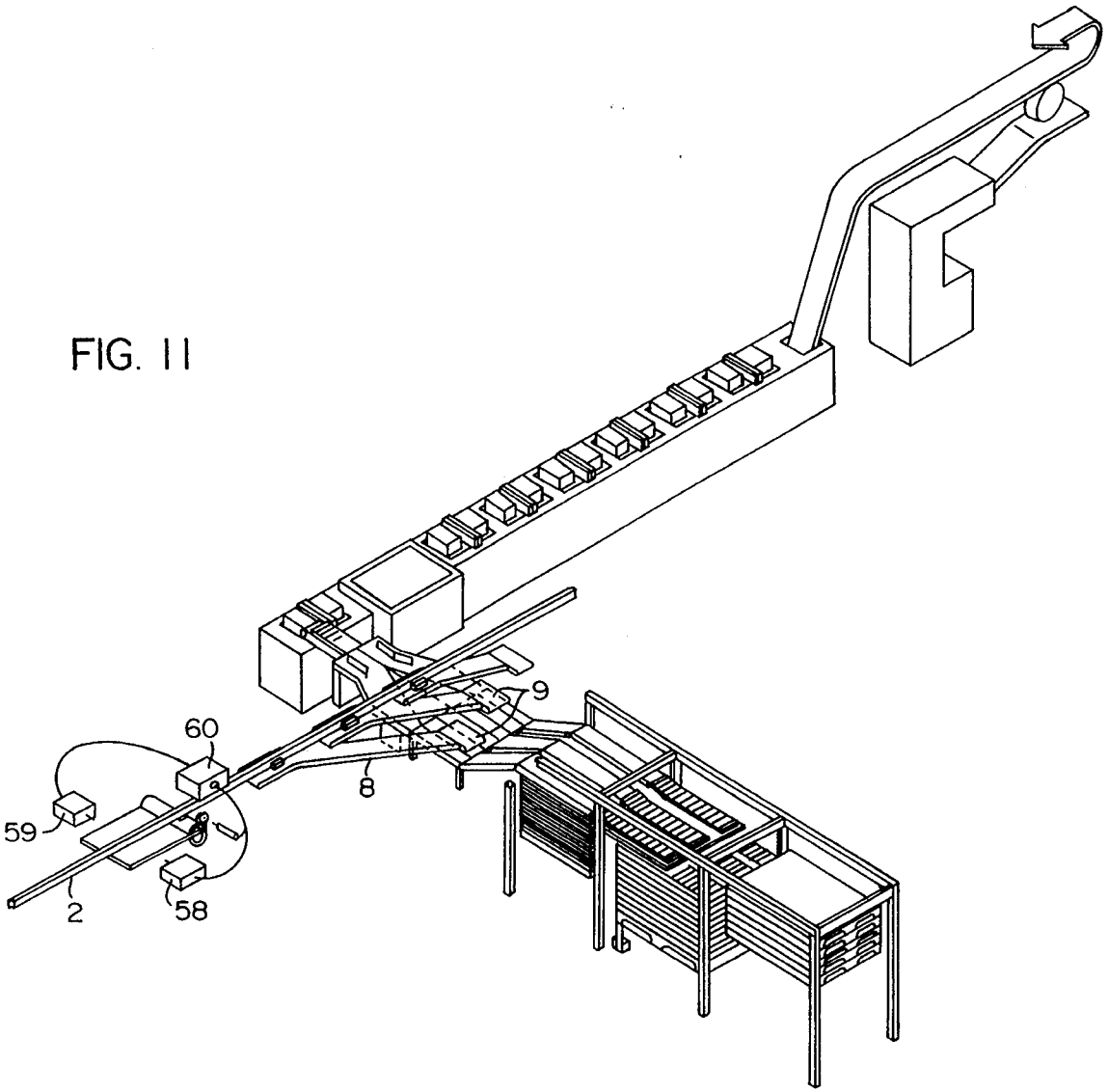
FIG. 11 is a view similar to that of FIG. 1 showing the counters and control.

As a further improvement, there is provided a (as shown in FIG. 11) copy counter 58 which senses the presence or absence of copy 18 in each gripper of conveyor 2. There is also gripper counter 59 which counts the grippers of conveyor 2. In this way, it is possible to determine when and where there are "holes" in the copy stream. Belts 8 and 9 are controlled by control 60 so that, when there is a hole, the belt stops for a suitable length of time to allow the next copy 18 to be properly deposited.

While only a limited number of specific embodiments of the present invention have been expressly described, it is, nonetheless, to be broadly construed and not to be limited except by the character of the claims appended hereto.

What we claim is:

1. A device for stacking and/or destacking a stream of imbricated, substantially planar, units to form and/or destack a layered stack, said device comprising a stacker, adapted to receive a stream of said units from a source thereof, and a plurality of transfer sheets in a sheet stack, at least one portion of said stream being delivered to said stacker;

said stacker comprising at least one staging belt adapted to receive said portion from said stream and deposit said units serially on one of said transfer sheets in a transfer direction, a mechanism for withdrawal of said one of said transfer sheets from said sheet stack, as said units are serially deposited to form an imbricated layer comprising said portion and said one of said transfer sheets, said stacker further adapted to deposit said imbricated layer on a removable support and to deposit each successive imbricated layer on an immediately preceding said imbricated layer thereby forming a bundle.

2. The device of claim 1 wherein said stream is provided by a feeder comprising a feed belt having said units thereon, said feed belt terminating above a diverter belt, said diverter belt being capable of movement at a speed different from that of said feed belt, whereby imbrication of said units in said stream can be controlled.

3. The device of claim 2 wherein said diverter belt and said feed belt are at a substantially right angle to each other.

4. The device of claim 1 further comprising a fold presser which imparts a compressive force to said units.

5. The device of claim 1 wherein said feeder comprises a gripper conveyor adapted to deposit said units on a feed belt, said feed belt terminating above a diverter belt.

6. The device of claim 1 wherein there are three said portions and three said staging belts parallel to and spaced apart from each other.

7. The device of claim 1 wherein said stacker comprises a base adapted for vertical movement whereby, as said stacker deposits said imbricated layers, said base adjusts its vertical position to serially receive said imbricated layers on a removable support.

8. The device of claim 7 comprising a plurality of said removable supports in a support stack, a support feed adapted to deliver one of said removable supports to said stacker as a preceding said layered stack is completed.

9. The device of claim 8 comprising a buffer which provides a temporary support for one said removable support, said temporary support adapted to receive and hold said one removable support while said preceding layered stack and its support are removed from said device, and thereafter release said temporary support onto said base.

10. The device of claim 1 wherein said feed belt and said stacker are reversible, an inclined nose adjacent said staging belt, said nose adapted to enter between each said transfer sheet and each said portion whereby, when each said transfer sheet is withdrawn from said layered stack, each said portion is received by said staging belt.

11. The device of claim 10 wherein said feeder comprises said staging belt which is reversible and adapted to deposit said each portion individually onto a converter table, thereby creating an exit stream of imbricated units.

12. The device of claim 10 wherein each said transfer sheet has a number of cut out notches corresponding and complementary to said noses.

13. The device of claim 1 wherein said stream is substantially continuous.

14. The device of claim 1 wherein said source is a gripper conveyor, and comprises a first sensor for determining whether said units are in grippers thereof, a second sensor for counting said grippers, and a control for controlling said device to maintain a continuous said stream of said units based on information received from said first sensor and said second sensor.

15. The device of claim 1 comprising a guide, a slider in said guide, and shovels on each said slider, said slider and said shovels adapted for movement parallel to said transfer direction between a first position adjacent said sheet stack and a second position adjacent said layered stack, said shovels adapted for movement toward each other into a gripping position, and away from each other into a release position, when said slider is in said first position and said shovels are in said gripping position, said shovels adapted to hold said transfer sheet and, as said slider moves to its second position, deposit said transfer sheet on said layered stack, when said shovels are in said release position, they are out of contact with said transfer sheets and said slider can move between said first position and said second position without moving said transfer sheet.

16. The device of claim 15 wherein said imbricated layers are deposited on a removable support, there being a plurality of said supports in a support stack, a support feed adapted to deliver one of said supports to said stacks as a preceding layered stack is completed, said support feed comprising said slider having a third position adjacent said support stack, said shovels, when in said gripping position and said slider are in said third position, adapted to hold said one support and, as said slider moves to said second position, deposit said support on a base for said layered stack, when said shovels are in said release position, they are out of contact with said support and said slider can move between said second position and said third position without moving said support.

17. The device of claim 15 wherein said guide comprises a pair of rails and there is a pair of sliders, one in each of said rails.

18. The device of claim 1 wherein there is a stager positioned adjacent the stacker said stager comprises an upper support, carrying an upper sheet stack which comprises a predetermined number of said transfer sheets, one of said sheets being at an appropriate level to permit withdrawal thereof, and a lower support, carrying a lower sheet stack which comprises a predetermined number of said transfer sheets, said stager adapted to, when said bundle is complete, transfer said one of said transfer sheets from said stager to said stacker and elevate said lower support and said lower stack to a point at which an uppermost transfer sheet of said lower stack is at said appropriate level.

19. The device of claim 18 wherein said bundle is removed from said stacker as or before transfer of said upper support to said stacker is complete.

20. A method of stacking a stream of imbricated, substantially planar units to form a layered stack, said method comprising a cycle of delivery of at least one portion of a stream of said units adjacent a transfer stack of transfer sheets, serially depositing said units onto an uppermost transfer sheet as said uppermost transfer sheet is withdrawn from a supply thereof, thereby forming an imbricated layer comprising said portion and said uppermost transfer sheet, depositing a first said imbricated layer on a first support, and depositing each successive imbricated layer on an immediately preceding said imbricated layer to form a bundle.

21. The method of claim 20 wherein there are three said portions parallel to and spaced apart from each other.

22. The method of claim 20 comprising positioning said first support to receive said first imbricated layer, thereafter lowering said first support by a first distance approximately equal to the height of said first imbricated layer, receiving said successive imbricated layers and lowering said first support by said first distance after receipt by said first support of each of said successive layers.

23. The method of claim 22 comprising further lowering said first support after said layered stack is complete, introducing a second said support above said layered stack, and removing said layered stack from beneath said second support.

24. The method of claim 23 wherein said layered stack is removed while said second support is being introduced above said stack.

25. The method of claim 20 wherein said cycle is repeated after completion of said first layered stack to form successive said layered stacks.

26. The method of claim 20 further comprising withdrawing an uppermost said imbricated layer from said layered stack, separating said portion from said transfer sheet, returning said transfer sheet to said supply, and discharging said portion.

27. The method of claim 20 comprising sensing missing said units in said stream, controlling said device to maintain a continuous said stream based on information as to said missing units.

28. The method of claim 20 wherein said supply comprises an upper support, carrying an upper sheet stack which comprises a predetermined number of said transfer sheets, said uppermost transfer sheet being at an appropriate level to permit withdrawal thereof, and a lower support, carrying a lower sheet stack which comprises a predetermined number of said transfer sheets, raising said upper support by a distance approximately equal to the height of said uppermost transfer sheet, after withdrawal from said upper stack of each said uppermost transfer sheet, when said bundle is complete, transferring said upper support and one of said transfer sheets to a position to receive said portion of said stream and elevation of said lower support and said lower stack so that an uppermost sheet of said lower sheet stack is at said appropriate level.

29. The method of claim 28 wherein a further support, carrying a further sheet stack which comprises a predetermined number of transfer sheets, is placed beneath said lower support as or after said elevation takes place.

30. A method of destacking a layered stack of imbricated, planar units, said method comprising a cycle of withdrawal of an imbricated layer which comprises a transfer sheet supporting a plurality of said units from said layered stack, serially separating said units from said transfer sheet to form an exit stream thereof, and depositing said transfer sheet to form a sheet stack.

31. The method of claim 30 wherein said withdrawal, said separating, and said depositing are substantially simultaneous.

32. The method of claim 30 wherein said imbricated layer comprises three rows of said units on said transfer sheet, said rows being parallel to and spaced apart from each other.

33. The method of claim 30 comprising raising said layered stack after each said withdrawal by a first distance approximately equal to the height of said imbricated layer, withdrawal of successive imbricated layers and raising said layered stack by said first distance after withdrawal of each of said successive layers.

34. The method of claim 30 wherein said cycle is repeated until all said imbricated layers have been withdrawn from said layered stack.

* * * * *